US010912372B2

(12) United States Patent
Soare

(10) Patent No.: US 10,912,372 B2
(45) Date of Patent: Feb. 9, 2021

(54) FACIAL STENCILS

(71) Applicant: Anastasia Soare, Beverly Hills, CA (US)

(72) Inventor: Anastasia Soare, Beverly Hills, CA (US)

(73) Assignee: ANASTASIA BEVERLY HILLS, LLC, Los Angeles, CA (US)

( * ) Notice: Subject to any disclaimer, the term of this patent is extended or adjusted under 35 U.S.C. 154(b) by 585 days.

(21) Appl. No.: 15/595,978

(22) Filed: May 16, 2017

(65) Prior Publication Data

US 2018/0332949 A1 Nov. 22, 2018

(51) Int. Cl.
*A45D 40/30* (2006.01)
*A45D 44/00* (2006.01)

(52) U.S. Cl.
CPC ..... *A45D 40/30* (2013.01); *A45D 44/00* (2013.01)

(58) Field of Classification Search
CPC ..... A45D 40/30; A45D 44/12; A45D 44/002; A45D 44/22; A61K 8/0212; A42B 1/041; A42B 1/046; A41D 13/1153
See application file for complete search history.

(56) References Cited

U.S. PATENT DOCUMENTS 3,557,805 A * 1/1971 Hamada ..... A45D 40/30 132/216
3,718,145 A 2/1973 Chateau
6,109,921 A 8/2000 Yau
6,289,801 B1 9/2001 Raymond
7,219,674 B1 5/2007 Shelley
8,015,981 B2 * 9/2011 Soare ..... A45D 44/00 101/127
8,342,190 B2 * 1/2013 Soare ..... A45D 44/00 101/127
8,505,552 B1 * 8/2013 Soare ..... A45D 40/30 132/216
8,763,614 B2 * 7/2014 Soare ..... A45D 44/00 132/213
8,881,740 B2 * 11/2014 Soare ..... A45D 44/00 132/200
8,997,757 B1 * 4/2015 Soare ..... A45D 26/00 132/200
9,204,702 B2 * 12/2015 Soare ..... A45D 26/00
9,210,989 B2 * 12/2015 Soare ..... A45D 44/00
(Continued)

OTHER PUBLICATIONS

International Search Report and Written Opinion, dated Aug. 10, 2018, from corresponding International Patent App. No. PCT/US2018/032669.

(Continued)

*Primary Examiner* — Nicholas D Lucchesi
(74) *Attorney, Agent, or Firm* — Greenberg Traurig, LLP

(57) ABSTRACT

Makeup stencils and kits include a pair of stencils. Each stencil of the pair includes a surface defining an outer region. There are on the outer region at least one indicium located about a periphery of the outer region. Each portion of the periphery is dimensioned for application of makeup or contouring. A makeup and contouring system includes providing an image of a face to be used with stencils. Guidelines are determined and areas are located via the guidelines. A face is shaped with contouring and lightening to have Golden Ratio proportions via different points and zones.

15 Claims, 7 Drawing Sheets

(56) References Cited

U.S. PATENT DOCUMENTS

| | | | | |
|---|---|---|---|---|
| 9,232,847 | B2 * | 1/2016 | Soare | A45D 44/00 |
| 9,449,412 | B1 | 9/2016 | Rogers et al. | |
| 9,460,557 | B1 | 10/2016 | Tran et al. | |
| D787,116 | S * | 5/2017 | Marchica | D28/7 |
| 9,760,762 | B2 * | 9/2017 | Soare | G06K 9/00248 |
| D800,963 | S * | 10/2017 | Marchica | D28/7 |
| D809,199 | S * | 1/2018 | Marchica | D28/7 |
| D811,655 | S * | 2/2018 | Marchica | D28/7 |
| D814,697 | S * | 4/2018 | Marchica | D28/7 |
| D814,698 | S * | 4/2018 | Marchica | D28/7 |
| D827,925 | S * | 9/2018 | Marchica | D28/7 |
| 2003/0063794 | A1 | 4/2003 | Rubinstenn et al. | |
| 2006/0254608 | A1 | 11/2006 | Lam | |
| 2007/0106182 | A1 | 5/2007 | Arnett | |
| 2008/0080746 | A1 | 4/2008 | Payonk et al. | |
| 2009/0151741 | A1 | 6/2009 | Ngo | |
| 2010/0018542 | A1 | 1/2010 | Konrad | |
| 2010/0031410 | A1 | 2/2010 | Clark | |
| 2010/0220933 | A1 | 9/2010 | Takano | |
| 2012/0044335 | A1 | 2/2012 | Goto | |
| 2012/0211022 | A1 | 8/2012 | Nakamura | |
| 2012/0223956 | A1 | 9/2012 | Saito et al. | |
| 2013/0280310 | A1 | 10/2013 | Suzuki et al. | |
| 2013/0306091 | A1 | 11/2013 | Soare | |
| 2015/0050624 | A1 | 2/2015 | Yamanashi et al. | |
| 2015/0359318 | A1 | 12/2015 | Martin et al. | |
| 2016/0015152 | A1 | 1/2016 | Ajiki et al. | |
| 2016/0022014 | A1 | 1/2016 | Ajiki et al. | |
| 2016/0125229 | A1 | 5/2016 | Soare | |
| 2016/0295997 | A1 | 10/2016 | Gradilla | |
| 2017/0364739 | A1 * | 12/2017 | Soare | G06K 9/00248 |

OTHER PUBLICATIONS

Jacono, A. A., "Where Beauty and Youth Converge" in The Face of the Future: Look Natural, Not Plastic: a Less-Invasive Approach to Enhance Your Beauty and Reverse Facial Aging, Chapter 2, Addicus Books, 2012, pp. 7-17.

Patnaik, V. V. G., et al., "Anatomy of a Beautiful Face and smile" *J. Anat Soc India* 52(1):74-80, 2003.

* cited by examiner

FACIAL STENCILS

RELATED APPLICATION

This application relates to Ser. No. 14/928,286 filed Oct. 30, 2015 by Anastasia Soare and entitled FACIAL STRUCTURAL SHAPING, the contents of which are incorporated by reference in its entirety herein.

BACKGROUND OF THE DISCLOSURE

This disclosure relates to cosmetic materials, and in particular to facial stencils for use in the application of makeup and contouring to the face.

The present disclosure relates generally to makeup stencils and kits and cosmetic applications.

A makeup stencil serves as a guide for applying makeup, e.g., for makeup and contouring to the cheek region of the face. Such makeup stencils can include a plurality of peripheral shapes and one or more cutouts having a pre-defined shape for applying makeup.

SUMMARY OF THE DISCLOSURE

One system and method in accordance with present disclosure includes providing a plurality of facial stencils or templates, then positioning, one by one, each stencil or template of the plurality of stencils or templates such that the stencil or template aligns with the different images of a person's face.

Each stencil or template can be presented as a relatively firm relatively hard yet flexible surface such as a transparency of a flexible plastic having an outline or a paper or board which is used for overlaying on selected portions of face of the person. Alternatively, the stencil or template can be provided as an electronic format and overlaid on a photo representation of the person's face.

The stencil or template is used to facilitate forming, shaping, emphasizing and de-emphasizing features of the face according to appropriate proportions and desired representations as provided by or on the stencils or templates.

The systems, stencils, templates and methods in accordance with the present disclosure enable a user to quickly and accurately determine the areas to apply makes and contouring to flatter and obtain the ideal shape of the facial features for any given user, for instance, according to the Golden Ratio standard and/or different desired characteristics.

The present disclosure, in part, is directed to makeup stencils and kits that address certain of the limitations of conventional approaches for using makeup, particularly, contouring. Thus, there has developed a need for a makeup stencil that can affect the contouring and makeup easier, more quickly, and more reliably, and in a user-friendly manner.

One non-limiting aspect of the present disclosure is directed to a makeup stencil including a surface defining an outer region in a curved manner, and at least one indicium located about a periphery of the outer region.

Another feature is for a first stencil to apply contouring in multiple positions about the face, around the cheek area and the forehead, and second stencil used for contouring to be applied on and around the nose and/or forehead.

Another non-limiting aspect of the present disclosure is directed to a makeup kit including packaging and one or more of the makeup stencils.

Further features, advantages and characteristics of the embodiments of this disclosure will be apparent from the following detailed description when taken in conjunction with the drawing figures.

Embodiments of the present disclosure are described in detail with reference to the accompanying drawings. The same or similar components may be designated by the same or similar reference numerals although they are illustrated in different drawings. Detailed descriptions of constructions or processes known in the art may be omitted to avoid obscuring the subject matter of the present disclosure. Further, in the following description of the present disclosure, various specific definitions found in the following description are provided only to provide a general understanding of the present disclosure, and it is apparent to those skilled in the art that the present disclosure can be implemented without such definitions.

DETAILED DESCRIPTION

Figure 1:
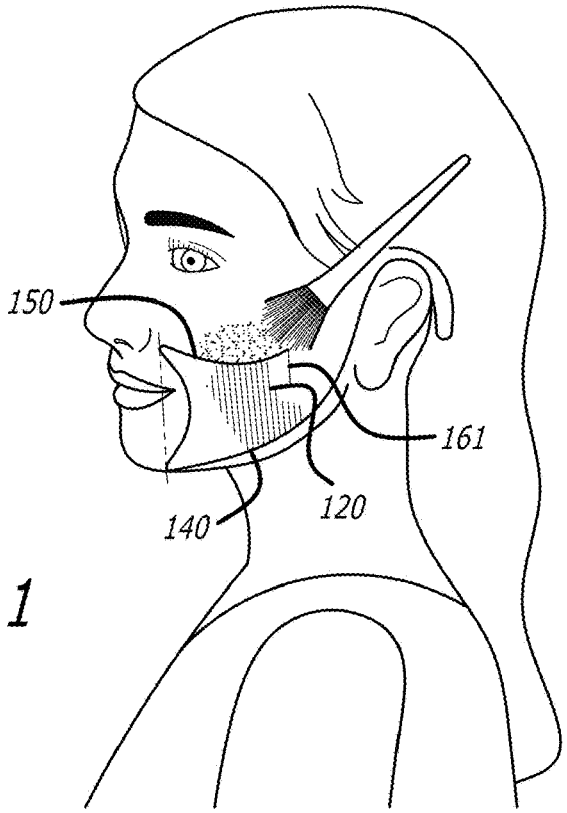
FIG. 1 is a view of a first makeup stencil in use of the face in a first form.
Figure 2:
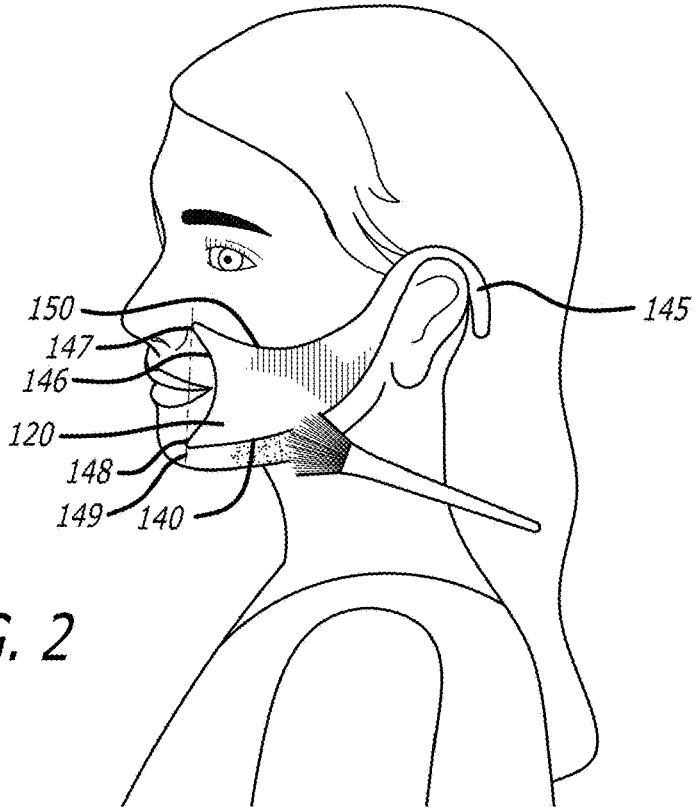
FIG. 2 is another view of a first makeup stencil in use of the face in a first form.
Figure 3:
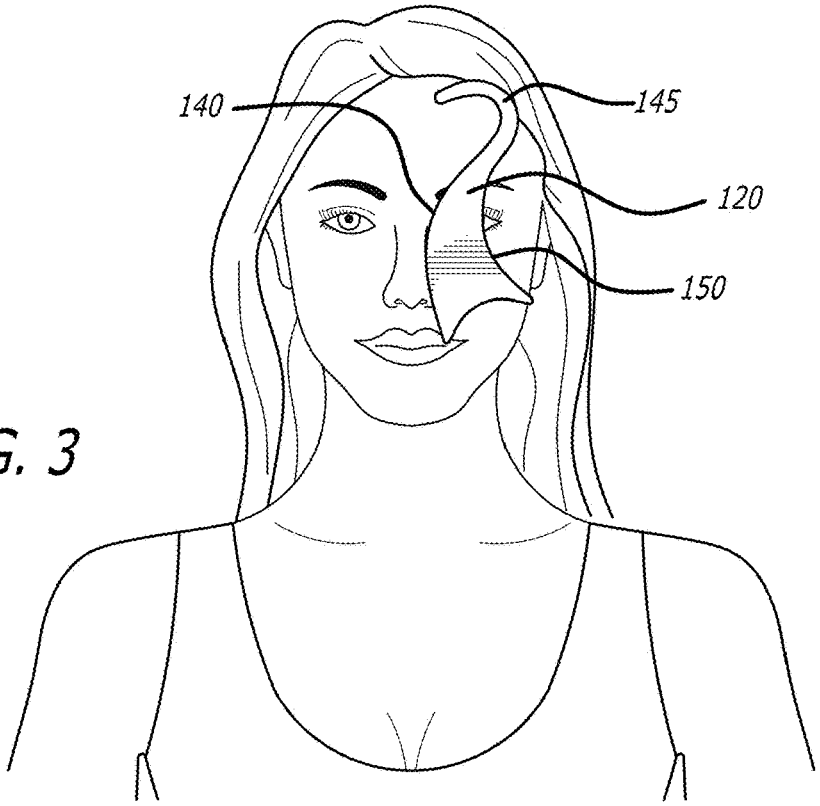
FIG. 3 is a view of a first makeup stencil in use of the face in a second form.
Figure 4:
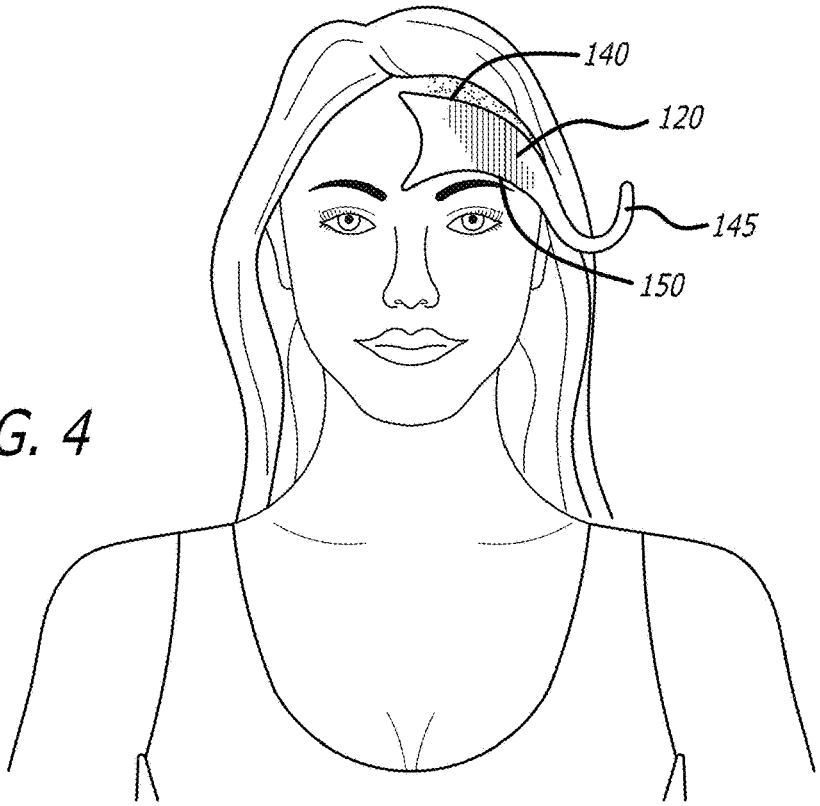
FIG. 4 is a view of a first makeup stencil in use of the face in a third form.
Figure 5:
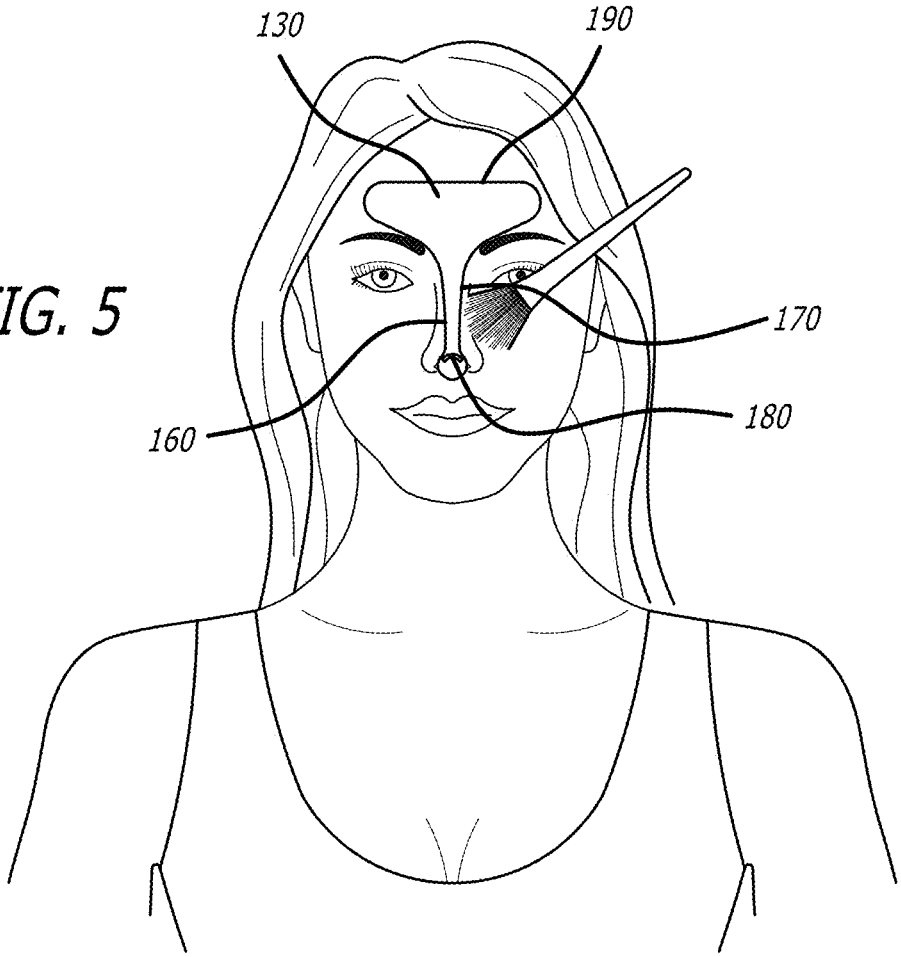
FIG. 5 is a view of a second makeup stencil in use of the face in first form.
Figure 6:
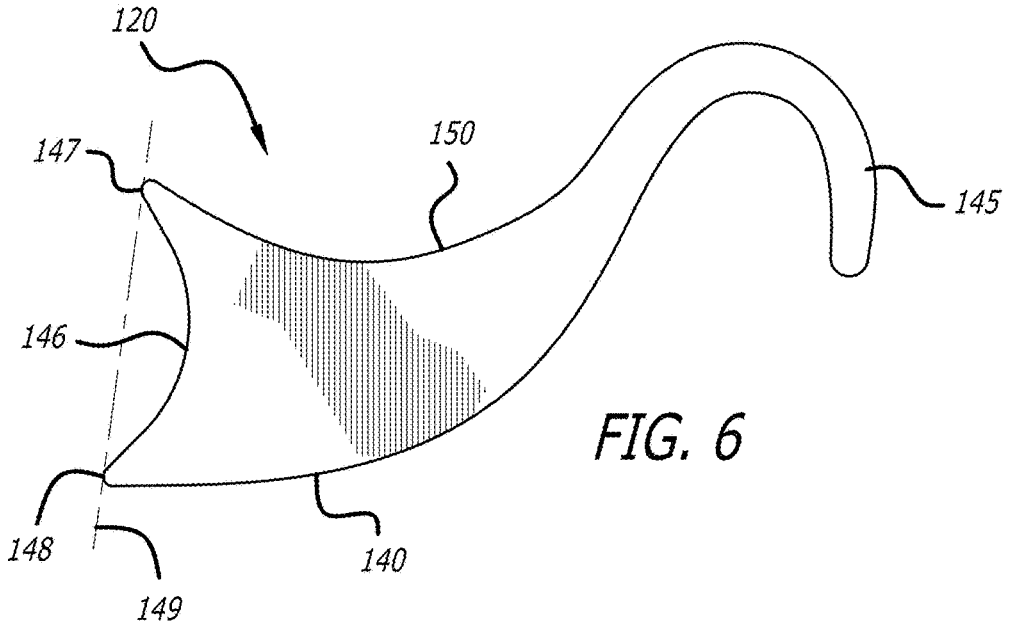
FIG. 6 is a view of a first makeup stencil.
Figure 7:
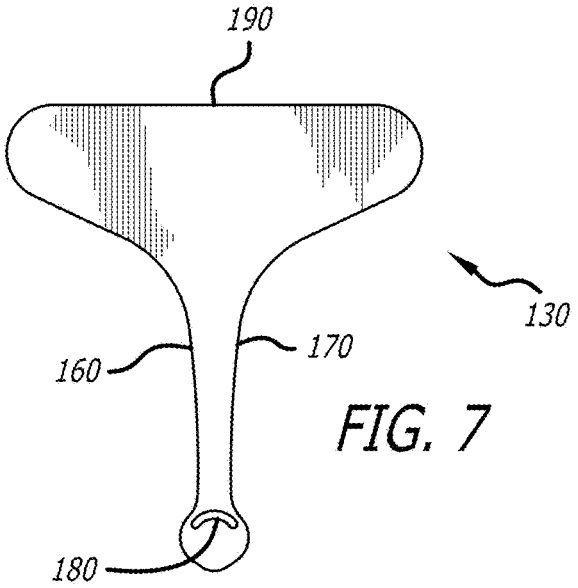
FIG. 7 is a view of a second makeup stencil with the wings.
Figure 8:
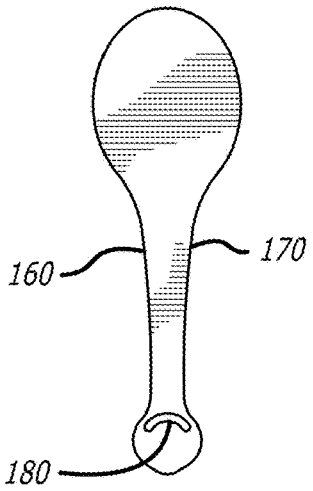
FIG. 8 is a view of a different form of second makeup stencil, without the wings.

There a pair of makeup stencils for facilitating the use of makeup and/or contouring to a face of a user around a cheek area, jaw bone area, forehead and nose of the user in relation to the face generally, and particularly the mouth, eyes, eyebrows and forehead of the user. One or more of the stencils are used in different positions on the face.

The stencils each have a surface defining an outer region dimensioned whereby contouring can be used on the face on different areas of the face around the outer region of the stencils.

A first stencil has a hook for location over an ear of the user adjacent the cheek area for applying makeup and/or contouring. There is a bottom periphery shape of the outer region of the first stencil to generally conform with the line of the jaw bone of the user and form part of the hook over the ear. A top periphery shape includes a line of the outer region arching in a concave area over the cheek of the user between an area near the bottom of the nose of the user and forms part of the hook over the ear.

There can be use of a single makeup stencil for application of makeup and/or contouring to a face of a user around a cheek area, jaw bone area of the user in relation to mouth, eyes, eyebrows and forehead of the user. In this manner, this first stencil has a surface defining an outer region dimensioned whereby contouring can be applied to the face on different areas of the face around the outer region. The stencil has a hook for location over an ear of the user adjacent the cheek area for applying makeup and/or contouring. There is a bottom periphery shape of the outer region of the first stencil is to generally conform with the line of the jaw bone of the user and form part of the hook over the ear. A top periphery shape is a line of the outer region arching in a concave area over the cheek of the user between an area near the bottom of the nose of the user and forms part of the hook over the ear.

When using the first stencil, the portion of the face below the eyes and over the zygomatic bone is defined for makeup and/or contouring.

A forward part of the stencil remote form the hook is relatively a concave outline around the edge of a mouth of the user. The outline of the first stencil is substantially concave over the cheek and convex over the portion to follow the jaw bone. When using the face piece, namely the first makeup stencil, the contouring of the jaw line goes all the way to the ear. The contouring above the stencil on the cheek under the eye should start from the ear and stop on the line vertical to the end of the iris (the side towards the ear). Then blending is affected.

A second stencil has an elongated narrow outline portion to conform to a dorsum, ridge or bridge of the nose of the user. The narrow portion expands over the top of the eyes to over the eyebrows and extend partly over the forehead. Near the end of the elongated portion there is a cut out or hole for permitting makeup to be added to the nose to create a button nose appearance. In this form, the cutout on the nose piece of the second makeup stencil is not in the middle. It is above the rounded part to apply contour and contour the nose like a button nose. This cut out is elongated as a slit like-slot and curved or arched, with the ends relatively lower than the central part.

The second stencil can have wings extending sideways above or over the eyes when the elongated portion is located on the top of the nose. In some cases, the second stencil does not have the wings.

The second stencil can be used as a single stencil. Here the makeup stencil is for application of makeup and/or contouring to a nose area of a user. It is a just a single stencil around the nose of the user in relation to mouth, eyes, eyebrows and forehead of the user. The stencil has a surface defining an outer region dimensioned whereby contouring can be applied to the face on different areas of the face around the outer region. The narrow portion expanding over the top of the eyes are in the form of wings to be above or to cover the eyebrows and extend partly over the forehead.

One or more of the stencils include at least one indicium located relative to a periphery of the outer region of at least one of the stencils. One or more of the stencils has a surface formed of a substantially transparent material, which is formed of a substantially pliable material.

When using the first stencil, a first guide line is formed on a cheek to demarcate a first limit for the application of contouring on the cheek. Then the first stencil with at least one peripheral outline is located relative the face by using the concave edge with the hook over the ear. Then a first makeup material is applied to the face to represent and shape the contouring. An area is created above the guide line and a second makeup material is applied to effect blending to the area of the line on the face. Also below the convex outline at the bottom of the stencil make up and contouring is applied in keeping with the jaw bone line of the user.

The first stencil includes a second application. This is by using the first stencil in an upside-down fashion. This is unrelated to being hooked on the ear. The surface is directed on the forehead and a line can be made coincident with the outline normally directed to the jawbone area in the first application. Contouring makeup can be applied to the forehead above the outline. There is also a third application of the first stencil, such application being adjacent to the nose.

The second stencil is used to form contouring area on either side of the ridge or dorsum of the nose, and applying makeup through the cut out to apply makeup to the near the end of the nose.

The materials of the stencils are of a material, shape, form and nature that they can be located on or adjacent to face features the face in a comfortable manner.

By using both stencils it is possible to define contouring a face to present an oval shape to the face and an appropriate button nose, thereby enhancing the facial appearance.

In use of one described format, stencil one:

- hooks over the ear (for positive positioning) and then contouring can be applied to the face
- contouring is applied around the outer periphery of the stencil (as opposed to cut outs)
- the bottom periphery shape of the stencil is to roughly conform with the bottom jaw bone
- the top line arches in a concave over the cheek between an area near the bottom of the nose and forms part of the hook over the ear
- the forward part of the stencil is concaved around the edge of the mouth.

When using the first stencil, the portion of the face below the eyes, namely over the zygomatic bone, can be defined for contouring.

In use of one described format, stencil two has:

- An arrow line elongated outline portion to conform to the bridge of the nose
- the narrow portion expands over the top of the eyes to cover the eyebrows and extend partly over the forehead
- near the end of the elongated portion there is a cut out for permitting makeup to be added to near the end of the nose.

The present disclosure, in part, is directed to makeup stencils and kits that address certain of the limitations of conventional approaches for applying makeup, particularly, a system of contouring to enhance the overall face and achieve an oval type appearance Referring to the figures, a non-limiting embodiment of a makeup kit is illustrated. The makeup kit includes a packaging and a makeup stencils 120 and 130.

The makeup stencils 120 and 130 may be located in a packaging tray. The makeup stencil 120 includes edges 140 and 150 respectively.

With stencil one, namely stencil 120, the outer edge 150 has at least one indicium 160 located at the periphery of the outer edge or region 150. The periphery of the outer region 150 is concave and is so dimensioned for application of a makeup along that line.

The edge 140 is substantially convex curved and can be a geometric form or a shape to conform to the jaw line at the bottom and the zygomatic bone at the top. In this form and placed over the cheek of a user there is a hook 145 for location over the ear of the user.

This stencil 120 can also be used in reverse or upside down partly over the forehead of the face. Application the stencil 120 is applied against the cheek in a second application, and selectively unrelated to being hooked on the ear. As such, the surface is directed on the forehead and a line can be made coincident with the outline normally directed to the jawbone area in the first application. On the forehead, the contouring and/or makeup is used above the outline 140. In a third application, the convex portion 140 is located adjacent the side of the nose, and selectively the hook portion 145 is over the forehead.

The forward part of the first stencil 120 remote form the hook 145 is relatively a concave 146 outline around the edge of a mouth of the user. The concave shape 146 of the forward part permitting the concave 150 and convex edges 140 to extend forwardly over the ends of the lips when considered essentially vertically and when the stencil 120 is in the first position over the cheek. The tips 147 and 148 of the stencil 120 are in a line 149 which is over the ends of the lips. Aligning this line 149 correctly can ensure that the stencil 120 is correctly placed on the face.

The second stencil 130 is the elongated portion with elongated edges 160 and 170 to either side so that makeup lines can be drawn to either side of the ridge or dorsum of the nose. The stencil 130 can be inwardly curved or formed from the tip end area of the stencil towards the wing sections so as to generally conform to the ridge or dorsum. There is a cut out or hole 180 through which makeup can be applied the near the end of the nose.

There can be several or at least one indicium 161 which can include a plurality of lines which can be straight or curved lines on either or both of the stencils.

The makeup stencils 120 and 130 are formed of a substantially transparent or translucent material so that the indicium and/or numbers, letters, or symbols 161 are visible from the front and/or rear. The makeup stencils 120 and 130 may be composed of a substantially pliable and lightweight material such as thin plastic, paper, or cardboard.

In using the makeup stencils 120 and 130, the makeup stencils 120 and 130 are positioned in proximity to a face as explained. The user depresses the makeup stencils 120 and 130 against the face, thereby forming close contact between certain stencils 120 and 130 and the face. The user then applies the makeup, lightening material and/or contouring material around the periphery by generally following the edge or contour of the periphery of the stencils 120 and 130

The facial stencils 120 and 130 on the face with its periphery is applied and used to relate to the contouring first and second guide lines. There can be one or more edges or straight lines to ensure the location substantially horizontally or vertically relative to the face when contouring is to be applied to the face. As such the face and the stencils are aligned in a correct sense with each other when the lines for contouring are demarcated. Makeup is applied to the face to represent and shape the contouring.

Between the edges and the demarcated lines 160 and 170 or to either side of the lines there are areas of the application of first and second makeup materials for contouring, lightening and blending. A method of effecting contouring comprises providing an image of a person's face, including a base of the person's nose, tip of the chin, cheeks, nostrils, eyes ears, and eyebrows.

As shown in the figures, there is a system and method comprising providing an image of a person's face, including a base of the person's nose, tip of the chin, cheeks, nostrils, eyes, ears, and eyebrows.

Figure 9:
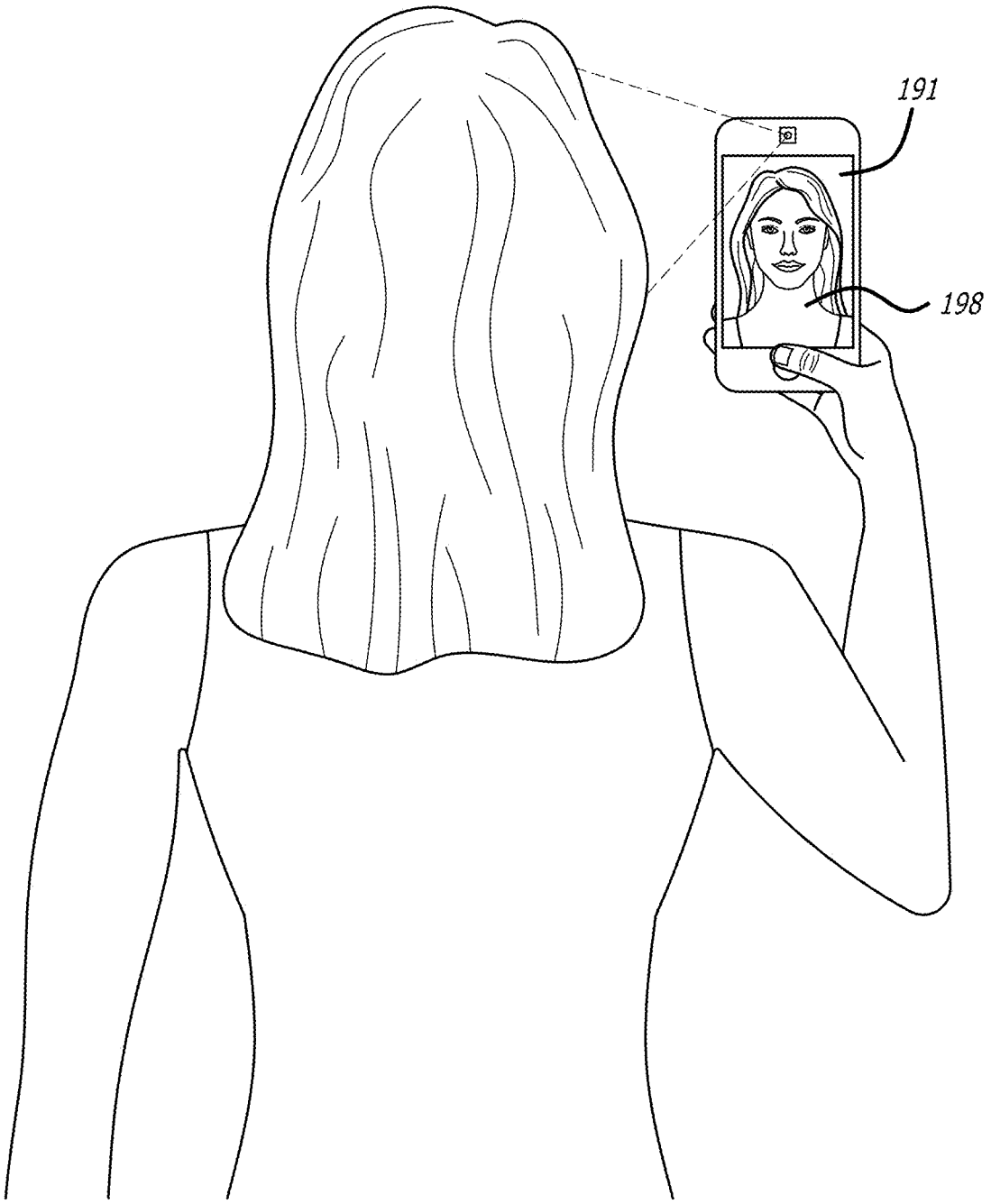
FIG. 9 is a person taking a photograph with a camera including a frontal image of a person's face in another form of the present disclosure.
Figure 10:
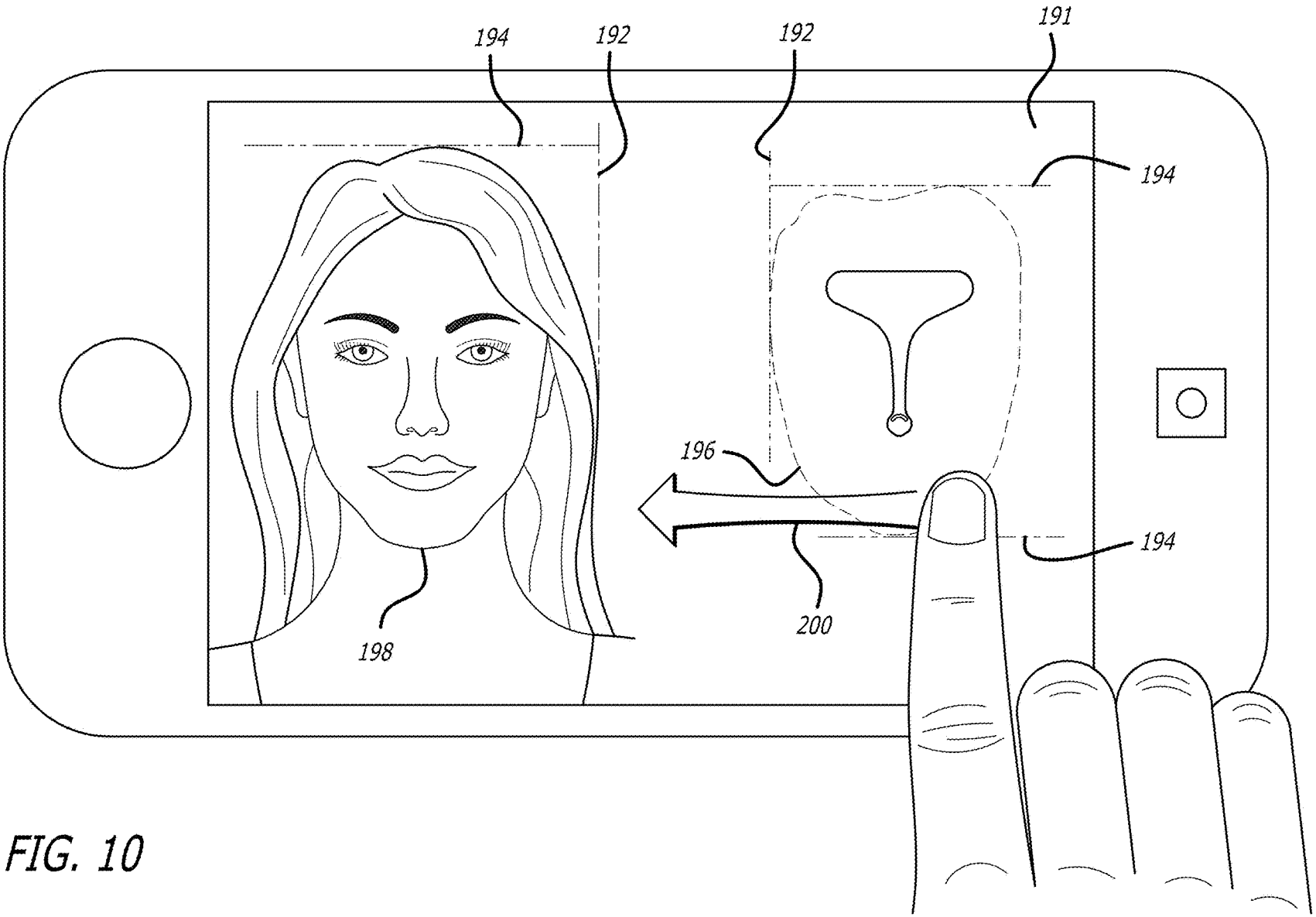
FIG. 10 is a person using the photograph on a camera monitor or screen including a frontal image of the person's face and acting to superimpose a stencil over the face in another form of the present disclosure.
Figure 11:
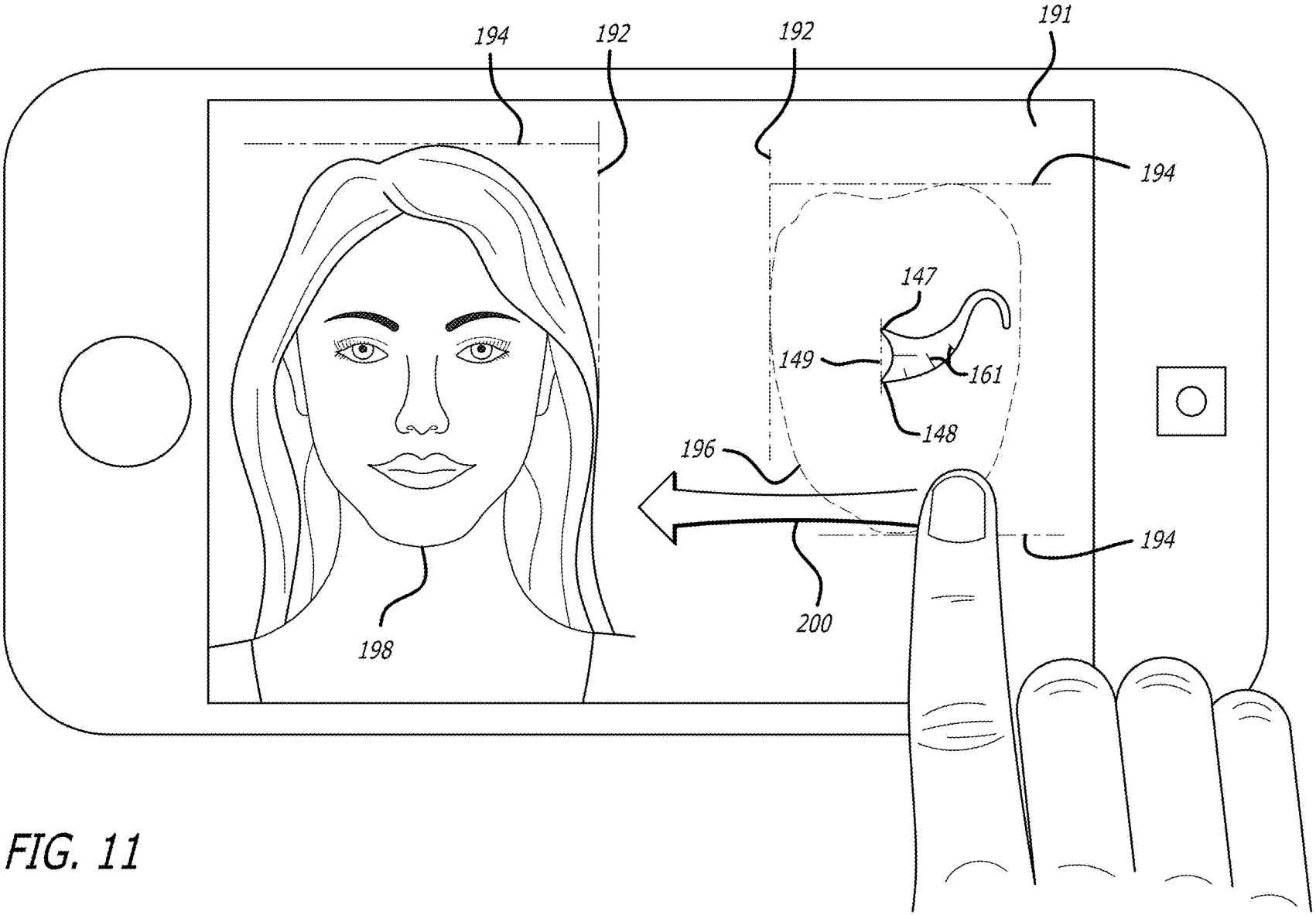
FIG. 11 is a person using the photograph on a camera monitor or screen including a frontal image of the person's face and acting to superimpose another stencil over the face in another form of the present disclosure.

As shown in FIGS. 9, 10 and 11, the implementation of the shaping of the face is achieved by using a stencil, which can be physical or electronically depicted on a screen 191 having the characteristics of at least partly periphery or vertical lines 192 and at least partly horizontal periphery or lines 194. These lines are useful so that when person lines up their face with the mask the alignment is correct. The face of the person when aligned with the stencil should be straight and vertically disposed with the stencil guide lines or periphery so that the overall stencil is correctly aligned and when used to establish the location of the lines and spaces are also formed or placed on the stencil, the stencil is correctly located relative to the face. As shown in in FIG. 11, the lines 192 and 194 on the on the screen 191 match up with the phantom line 149 between tips 147 and 148, so as to facilitate correct aligning of the stencil. There are other lines or indicia 161 on the stencil which can be used for alignment when using the stencil so the user can better align where the contour should stop. These lines can be used in different forms of eth disclosure relating to the stencils.

There can be a system and method applying the method or system of anyone or more of the figures. This is affected by applying a stencil or silhouette 196 representing the lines and distances over a face of the person. The face is represented as a photograph 198 on a paper, transparency, monitor or screen of a computer, tablet or smart phone. The user would apply, for instance by dragging 200 the silhouette representation of figures over the photo of face and with that, will be able to match a design an appropriate makeup formation over the face.

Methods and systems in accordance with the present disclosure enable even a relatively unskilled person to quickly and accurately determine the location and shape of her eyebrows according to the Golden Ratio standard.

One exemplary method of the present disclosure is illustrated in the figures. The image of the person's face may be a reflection in a mirror or it may be a displayed photographic image of the person's face on a display device such as on a laptop display, desktop computer display, tablet computer or cell phone screen. In a preferred embodiment, the image of the person's face is a full-face view (i.e., taken at an angle of 0 degrees relative to the face). In another embodiment, the image may show only a portion of the face.

In other embodiments, the image may be taken from one side of the face at an angle of not greater than 45 degrees relative to the face, or more preferably at an angle of not greater than 20 degrees relative to the face, or more preferably at an angle of not greater than 10 degrees relative to the face.

A method and a system of applying the stencil and system uses a template representing the lines and distances over a face of the person. The face is represented as a photograph on a paper, transparency, monitor, or screen of a computer, tablet or smart phone.

The process by which the application is used electronically. The mirror utility of a software computer app. on the screen shows the face of the user. The face is aligned vertically and/or horizontally with the image on the screen. The program will move to the next stage when this alignment is affected. If the alignment moves off a designated position the program will not proceed to the next stage. There is a continual feedback to ensure the correct alignment.

There is continual feedback and comparison of the facial image after makeup and/or contouring is applied to the face of the user with the ideal image as shown in the figures on the screen. When there is a satisfactory or acceptable result, the user can move the program to the next image of figures. The user can begin and end with any one of figures and/or apply them in any order.

The superimposition action of the contour lines over the picture can be adjustable. This allows the user to drag that contour line image, drop it over the specific part of the face, and to stretch or minimize by using a touch screen to properly position it. The alignment should keep the proportions.

Changes and alternatives may be introduced without departing from the spirit and broad scope of my disclosure as defined by the claims below and their equivalents

The invention claimed is:

1. A pair of makeup stencils for application of makeup and/or contouring to a face of a user around a cheek area, jaw bone area and nose of the user in relation to mouth, eyes, eyebrows and forehead of the user comprising:

the stencils each having a surface defining an outer region dimensioned whereby contouring can be applied to the face on different areas of the face around the outer region;

a first stencil having a hook forward part remove from a hook for location extending over and behind an ear of the user with the forward part adjacent the user's cheek area for applying makeup and/or contouring around the forward part of the first stencil, a bottom periphery shape of the outer region of the first stencil is to generally conform with a line of the jaw bone of the user and form part of the hook over the ear; a top periphery shape being a line of the outer region arching in a concave area over the cheek of the user between an area near the bottom of the nose of the user and forms part of the hook over the ear;

a second stencil having an elongated narrow concave outline portion to conform to a bridge of the nose of the user; the narrow portion expanding over the top of the eyes to over the eyebrows and extend partly over the forehead, and near the end of the elongated portion there is a cut out for permitting makeup to be added near the end of the nose.

2. The stencils of claim 1 including at least one indicium located relative to a periphery of the outer region of at least one of the stencils.

3. The stencils of claim 1 wherein when using the stencils as a pair, the portion of the face below the eyes and over the zygomatic bone is defined for makeup and/or contouring.

4. The stencils of claim 1, wherein the outline of the first stencil is substantially concave over the cheek and convex over the portion to follow the jaw bone, and a forward part of the stencil remote form the hook is relatively a concave outline around the edge of a mouth of the user, and the concave shape of the forward part permitting concave and convex edges of the first stencil to extend forwardly over the ends of the lips when considered essentially vertically and when the first stencil is in position over the cheek of the user.

5. The stencils of claim 1, wherein the surface is formed of a substantially transparent material.

6. The stencils of claim 1, wherein the surface is formed of a substantially pliable material.

7. The stencils of claim 1, including using the first stencil and forming a first guide line on a cheek to demarcate a first limit for the application of contouring on the cheek, applying and using the fist stencil having at least one peripheral outline for location relative the face with the hook over the ear and applying a first makeup material to the face to represent and shape the contouring.

8. The stencils of claim 7, including creating an area above the guide line and applying a second makeup material to effect blending to the area of the first guide line on the face.

9. The stencils of claim 1, including using the second stencil to form contouring area on either side of ridge of the nose, and applying makeup through the cut out to apply makeup to near the end of the nose.

10. The stencils of claim 1, including in a second application using the first stencil in an upside-down fashion, unrelated to being hooked on the ear so that the surface is directed on the forehead and a line can be made coincident with the outline normally directed to the jawbone area in the first application on the forehead so that contouring makeup can be applied to the forehead above the outline.

11. The stencils of claim 1, including having on the second stencil wings extending sideways above or over the eyes when the elongated portion is located on the top of the nose.

12. A makeup stencil for application of makeup and/or contouring to a face of a user around a cheek area, jaw bone area of the user in relation to mouth, eyes, eyebrows and forehead of the user comprising the stencil having a surface defining an outer region dimensioned whereby contouring can be applied to the face on different areas of the face around the outer region;

the stencil having a hook for location over and behind an ear of the user and a forward part positionable adjacent the cheek area for applying makeup and/or contouring, the forward part having a bottom periphery shape being a line of the outer region positionable to generally conform with the line of the jaw bone of the user and form part of the hook over the ear; and a top periphery shape being a line of the outer region arching in a concave area over the cheek of the user between an area near the bottom of the nose of the user and forms part of the hook over the ear.

13. The stencil of claim 12, including a structure whereby in a first application the stencil is applied against the cheek with the concave area at the top and a convex portion at the bottom, and in a second application using the stencil in an upside-down fashion, unrelated to being hooked on the ear so that the surface of the forward part is directed on the user's forehead and a line can be made coincident with the outline normally directed to the jawbone area in the first application on the forehead so that contouring makeup can be applied to the forehead above the outline, and in a third application, the convex portion of the forward part is located adjacent the side of the user's nose, and selectively the hook is portion over the user's forehead.

14. A makeup stencil for application of makeup and/or contouring to a face of a user around the nose of the user in relation to mouth, eyes, eyebrows and forehead of the user comprising: the stencil having a surface defining an outer region dimensioned whereby contouring can be applied to the face on different areas of the face around the outer region; the stencil having an elongated narrow concave outline portion to conform to a bridge of the nose of the user; the narrow portion, when the stencil is placed on the top of the user's nose, expanding over the top of the eyes to over the eyebrows and extending partly over the forehead, and towards the tip of the elongated portion there is a cut out for permitting makeup to be added to a tip of the nose.

15. The stencil of claim 14, including having on the stencil wings extending sideways above or over the eyes when the elongated portion is located on the top of the nose.

* * * * *